United States Patent [19]

Nix et al.

[11] 4,059,153

[45] Nov. 22, 1977

[54] WEIGHT AND PRESSURE OPERATED WELL TESTING APPARATUS AND ITS METHOD OF OPERATION

[75] Inventors: George J. Nix, London, England; Burchus Q. Barrington; David L. Farley, both of Duncan, Okla.; Norman G. Hortman, Laurel, Miss.

[73] Assignee: Halliburton Company, Duncan, Okla.

[21] Appl. No.: 746,913

[22] Filed: Dec. 2, 1976

Related U.S. Application Data

[62] Division of Ser. No. 595,648, July 14, 1975.

[51] Int. Cl.[2] ..... E21B 43/12

[52] U.S. Cl. ..... 166/264

[58] Field of Search ..... 166/264, 315, 319, 321, 166/334

[56] References Cited

U.S. PATENT DOCUMENTS

| | | | |
|---|---|---|---|
| 2,951,536 | 9/1960 | Garrett | 166/322 |
| 3,007,669 | 11/1961 | Fredd | 166/321 |
| 3,351,133 | 11/1967 | Clark, Jr. et al. | 166/53 |
| 3,356,145 | 12/1967 | Fredd | 166/322 |
| 3,467,185 | 9/1969 | Dowden | 166/334 |
| 3,796,261 | 3/1974 | Nutter | 166/334 |
| 3,856,085 | 12/1974 | Holden et al. | 166/324 |
| 3,860,069 | 1/1975 | Wray et al. | 166/321 |
| 3,893,512 | 7/1975 | Carroll et al. | 166/73 |

*Primary Examiner*—James A. Leppink

*Attorney, Agent, or Firm*—Floyd A. Gonzalez; John H. Tregoning

[57] ABSTRACT

A method and apparatus are presented which are particularly useful in testing the production capabilities of offshore oil wells. The apparatus includes a normally closed, weight operated valve which opens a preset delay after the weight operated valve is subjected to sufficient weight such as when a test string is set down upon, and supported by, a packer isolating an underground formation; and a normally open, weight and pressure operated valve which closes immediately when the test string is set down upon the packer. The weight and pressure operated valve expands a sealed chamber when subjected to sufficient weight to close its associated valve. The weight and pressure operated valve also includes a pressure responsive piston which opens and closes the valve, and which is responsive to the pressure in the sealed chamber, and to fluid pressure in the well annulus. Thus, when the pressure in the annulus acting on the piston, aided by the low pressure in the sealed chamber, is sufficient to overcome the weight of the test string acting on the closed weight and pressure operated valve, the valve will move from its closed to its open position, thereby allowing a testing program to be conducted by increasing and decreasing the pressure in the annulus. Also included in the test string is a collapsing slip joint which allows movement in the test string in order that the pressure responsive piston may move to operate the weight and pressure operated valve in response to pressure changes in the annulus. A testing string results in which the production of the oil well may be tested by lowering into the well a normally closed, weight operated valve adjacent to a normally open, weight and pressure operated valve; setting a packer to isolate the formation to be tested; adding sufficient weight on the packer to immediately close the weight and pressure operated valve, and to open the weight operated valve after a predetermined delay; and, increasing and decreasing the pressure in the fluid in the well annulus to responsively open and close the weight and pressure operated valve to thereby test the formation.

4 Claims, 13 Drawing Figures

FIG. 1
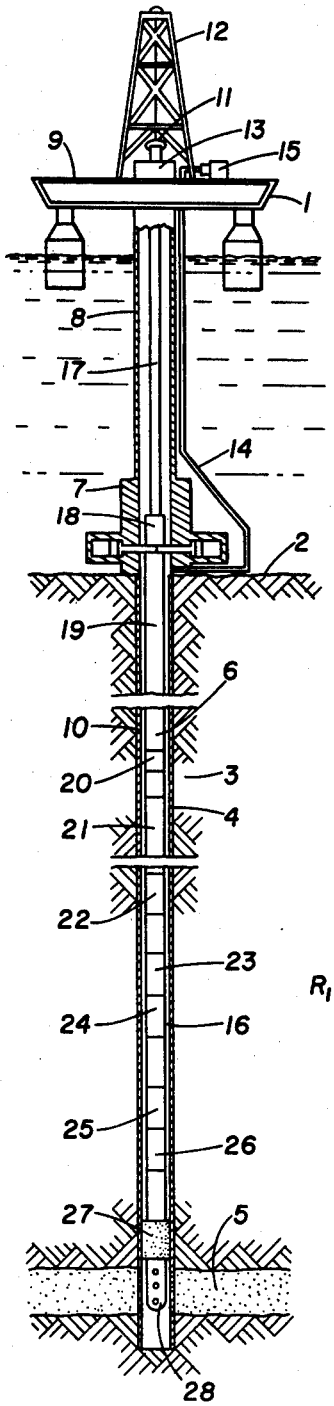
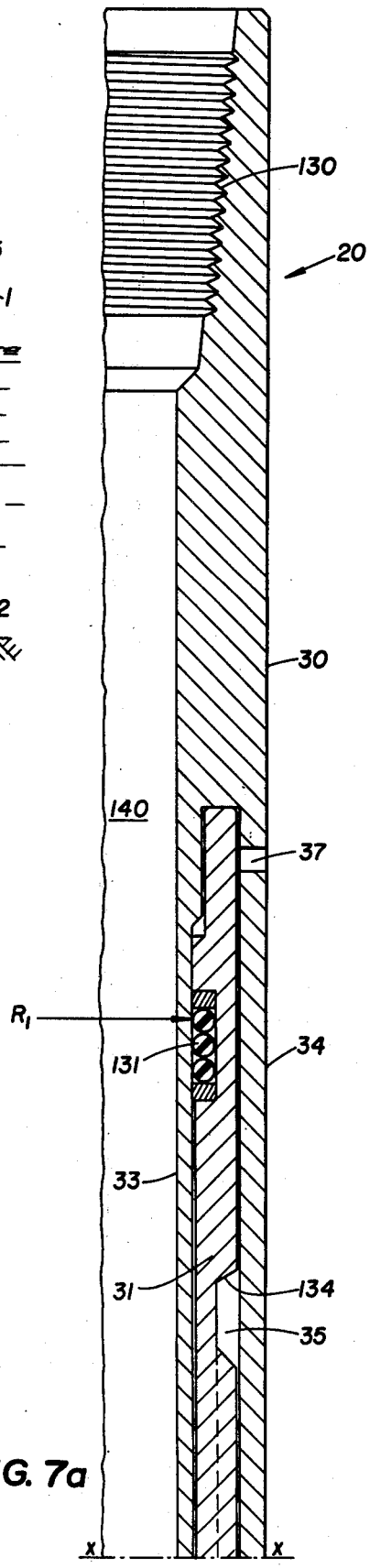
FIG. 7a
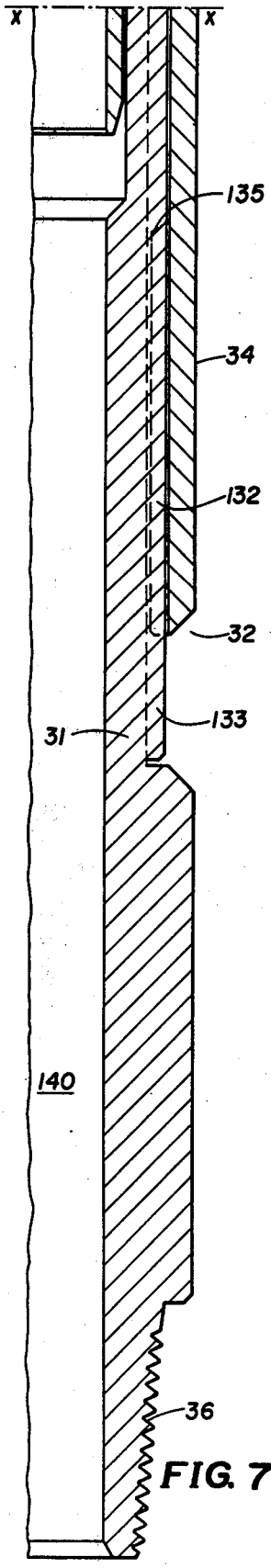
FIG. 7b

WEIGHT AND PRESSURE OPERATED WELL TESTING APPARATUS AND ITS METHOD OF OPERATION

GENERAL BACKGROUND AND SUMMARY OF THE INVENTION

This is a division, of application Ser. No. 595,648, filed July 14, 1975.

The invention disclosed relates to the testing of formations in oil wells, and is most advantageous in conducting tests in offshore oil wells where it is desirable to conduct a well testing program with a minimum of tool string manipulation, and preferably with the blowout preventers closed during a major portion of the program.

It is known in the art that sampler valves and tester valves for testing the productivity of oil wells may be operated by applying pressure increases to the fluid in the annulus of the well. For instance, U.S. Pat. No. 3,664,415 to Wray et al. discloses a sampler valve which is operated by applying annulus pressure increases against a piston in opposition to a predetermined charge of inert gas. When the annulus pressure overcomes the gas pressure, the piston moves to open a sampler valve thereby allowing formation fluid to flow into a sample chamber contained within the tool, and into the testing string facilitating production measurements and testing.

U.S. Pat. No. 3,858,649 to Holden et al. also discloses a sampler apparatus which is opened and closed by applying pressure changes to the fluid in the well annulus. A gas pressure supplementing means is included in the aforementioned Holden patent to avoid the necessity of determining the proper gas operating pressure at the testing depth and to allow the use of lower inert gas pressure at the surface. U.S. Pat. No. 3,856,085 to Holden et. al. provides a full opening testing apparatus containing a pressurized inert gas whose pressure is supplemented as the apparatus is lowered into the well, and which is operable by increasing an decreasing the pressure of the fluid in the well annulus.

The apparatus of the above mentioned patents all require compressed inert gas as a spring medium and therefore require special equipment and training for the transportation and storage of said compressed gas.

Weight operated tester valves which open after a desired delay are known in the art. One such device is disclosed in U.S. Pat. No. 3,814,182 to Giroux. However, this device used alone requires that the test string be manipulated up and down in order to operate the valve mechanism. It is desirable in conducting a test, for safety reasons, to maintain the blowout preventers closed to the maximum extent possible. This cannot be done if the test string must be manipulated to operate the valve.

Slip joints to allow movement in the test string are known, but have heretofore been used to minimize the transmission of wave action to the packer and valving mechanisms One such slip joint is disclosed in U.S. Pat. No. 3,354,950 to Hyde. However, these slip joints have not been used to allow motion in the test string after the blowout preventer is closed in order to facilitate the operation of a weight and pressure responsive valve mechanism which lifts the lower portion of the test string in response to pressure increases in the well annulus. In addition, the slip joint disclosed in the Hyde patent mentioned above tends to affect the apparent weight acting on the weight and pressure responsive valve responsive to the initial fluid in the test string and the fluid pressure in the well annulus. Thus, if the initial fluid is displaced by lower density formation fluid, or when the fluid pressure in the well annulus is changed, the apparent weight acting on said weight and pressure operated valve may be changed sufficiently that the weight and pressure operated valve may not operate correctly as desired.

The present invention comprises a weight and pressure responsive valve controlling fluid communication in an oil well including a housing having an internal sealed chamber and an operating mandrel movable in one direction responsive to weight, and movable in a second opposite direction responsive to pressure in said sealed chamber and to the pressure of the fluid in the annulus of the well, wherein movement of the mandrel in the first direction expands the sealed chamber reducing the pressure therein. Said valve is closed when sufficient weight acts upon the valve to move the operating mandrel in the first direction, and to expand the sealed chamber. When sufficient pressure is added to the annulus of the well, the mandrel moves in said second direction responsive to the pressure in the annulus and the reduced pressure in the sealed chamber to overcome said weight, thereby closing said valve. Thus a valve results which is operable by setting a predetermined amount of weight on a packer isolating a formation to be tested, and by increasing and decreasing the pressure of the fluid in the well annulus.

The weight and pressure responsive valve additionally is a full opening device and is separable into an operating unit and a valving unit. These units are jointed by a connecting joint which assures proper alignment between the units. The operating mandrel is further designed to deform a sufficient amount to allow for design tolerance, thus protecting the valve operating mechanism from excess stresses. Further, the operating mandrel and the housing of the apparatus provides for the transmission of torque, thus allowing the use of backers operable by rotation.

The test string of the invention includes a normally closed, weight operated valve which opens responsive to sufficient weight acting upon the valve after a preset delay. The weight operated valve is also a full opening valve, thus giving a testing string which has an unobstructed, fully open interior bore when both the weight and pressure responsive valve, and the weight operated valve are open. The delayed opening feature allows sufficient time for the weight and pressure operated valve to close initially before the weight operated valve opens, thus insuring that the interior bore will not open prematurely.

The slip joint provided in the testing string allows movement in the test string after the blowout preventer is closed, thus allowing the weight and pressure responsive valve to be operated by applications of pressure to the annulus with the blowout preventers closed. The slip joint determined by its position the weight supported by the packer, thus providing for changing the weight acting on said weight and pressure responsive valve and said weight operated valve, thereby providing a testing string which may be used at various depths and with various densities of fluids in the well. The slip joint is additionally compatible with the weight and pressure responsive valve to pullify the effects of fluid pressure in the interior bore of the testing string, and pressure changes in the well annulus, in order that the apparent weight acting on weight and pressure responsive valve will not change when formation fluid displaces the original fluid in the string or when the fluid pressure in the well annulus is changed. The slip joint also provides for torque transmission.

The testing string incorporating the disclosed invention allows a formation to be tested by lowering a testing string into a fluid filled bore; setting a packer to isolate the formation to be tested; setting a predetermined amount of weight on the packer to close a normally open weight and pressure responsive valve; after a preset delay, opening a normally closed weight operated valve responsive to the added weight; and, opening and closing the weight and pressure responsive valve by increasing and decreasing the pressure of the fluid in the well bore.

The interior bore of the test string may be fully open, thus allowing the passage of well tools through the test spring when both valves are open. A slip joint absorbs the motion of the weight and pressure responsive valve during its operation, thus allowing the testing program to be conducted while the blowout preventers are closed.

THE DRAWINGS

A brief description of the appended drawings follows:

FIG. 1 provides a schematic "vertically sectioned" view of a representative offshore installation which may be employed for formation testing purposes and illustrates a formation testing "string" or tool assembly in position in a submerged well bore and extending upwardly to a floating operation and testing station.

FIG. 2 provides a schematic view of selected apparatus from the testing string of FIG. 1 as the tools would appear while the string is being "run in" or lowered into the well bore.

FIG. 3 provides a schematic view of the apparatus of FIG. 2 as they would appear after the packer is set and the weight and pressure responsive valve is closed, but before the delay of the weight operated valve has elapsed.

FIG. 4 provides a schematic view of the apparatus of FIG. 3 as they would appear after the delay of the weight operated valve has elapsed, and the weight operated valve has opened.

FIG. 5 provides a schematic view of the apparatus of FIG. 4 as they would appear during a portion of the test with the weight and pressure responsive valve open, the weight operated valve open, and the slip joint partially collapsed.

FIGS. 6*a*–6*f*, joined along section line *a*—*a* through *e*—*e*, provide a view of the preferred weight and pressure responsive, full opening valve in the normally open position.

FIGS. 7*a* and 7*b*, joined along section line *x*—*x*, provide a view of the preferred slip joint in the fully collapsed position.

OVERALL TESTING ENVIRONMENT

During the course of drilling an oil well the borehole is filled with a fluid known as "drilling fluid" or "mud." One of the purposes, among others, of this drilling fluid is to contain in the intersected formations any fluid which may be found there. This is done by weighting the mud with various additives so that the hydrostatic pressure of the mud at the formation depth is sufficient to keep the formation fluid from escaping out of formation into the borehole.

When it is desired to test the production capabilities of the formation, a testing string is lowered into the borehole to the formation depth and the formation fluid is allowed to flow into the string in a controlled testing program. Lower pressure is maintained in the interior of the testing string as it is lowered into the borehole. This is usually done by keeping a valve in the closed position near the lower end of the testing string. When the testing depth is reached, a packer is set to seal the borehole thus "closing-in" the formation from changes in the hydrostatic pressure of the drilling fluid.

The valve at the lower end of the testing string is then opened and the formation fluid, free from the restraining pressure of the drilling fluid, can flow into the interior of the testing string.

The testing program includes periods of formation flow and periods when the formation is "closed-in." Pressure recordings are taken throughout the program for later analysis to determine the production capabilities of the formation. If desired, a sample of the formation fluid may be caught in a suitable sample chamber.

At the end of the testing program, a circulation valve in the test string is opened, formation fluid in the testing string is circulated out, the packer is released, and the testing string is withdrawn.

In an offshore location, it is desirable to the maximum extent possible, for safety and environmental protection reasons, to keep the blowout preventers closed during the major portion of the testing procedure and to eliminate testing string movement to operate downhole valves. For these reasons testing tools which can be operated by changing the pressure in the well annulus surrounding the testing string have been developed.

FIG. 1 shows a typical testing string being used in a cased, offshore well. A floating drilling vessel or work station 1 is positioned over a submerged work site 2; a well bore 3 having been drilled and lined with a casing string 4 to a formation 5 to be tested. Formation fluid in formation 5 may communicate with the interior 6 of the testing string 10 through perforations provided in the casing string 4 opposite the formation 5.

A submerged well head installation 7 including a blowout preventer mechanism is provided and may be of the type shown in FIG. 2 of U.S. Pat. No. 3,646,995 to Manes et al. A marine conductor 8 extends between the well head 7 and the work station 1. The deck structure 9 on work station 1 provides the work platform from which formation testing string 10, comprising a plurality of generally tubular components, is lowered by hoisting means 11 through marine conductor 8, well head installation 7, and well bore 3, to formation 5. Derrick structure 12 supports hoisting means 11. Well head closure 13 closes off the annular opening between the testing string 10 and the top of marine conductor 8.

A supply conduit 14 is provided to transmit fluids such as drilling mud to the annulus 16 between the test string 10 and the casing string 4 below the blowout preventers of installation 7. A pump 15 is provided to impart pressure to the fluid in conduit 14. An upper conduit string portion 17 usually made up of threadably interconnected conduit sections extends from the work site 1 to a hydraulically operated conduit string "subsea test tree" 18 such as that identified as 801 in the above mentioned Manes et al. patent, and which is sold by Otis Engineering Corporation of Dallas, Texas.

An intermediate conduit portion 19 extends from the subsea test tree 18 to a torque transmitting, slip joint 20, disclosed herein. Below slip joint 20 is an intermediate conduit portion 21 for imparting weight to the lower portion of the string 10, and is usually made up of drill collars. The length of conduit portion 21 is determined by such factors as the density, referred to as "weight," of the mud, the depth of the formation, the operating pressure desired, the weight and dimensions of the drill collars, and the density referred to as "weight," of the initial cushion fluid in the interior 6 of the drill string 10. This length determination is set out herein, at a later point.

A circulation valve 22 is provided to provide communication between the well annulus 16 and the interior 6 of the string 10 after the testing program is complete in order that formation fluid trapped in the interior 6 may be circulated to the surface and safety disposed of before the testing string 10 is withdrawn. The circulation valve 22 additionally allows fluid in the interior 6 to drain into the annulus 16 as the testing string is being withdrawn in order that the string may be pulled "dry." The circulation valve 22 may be operated by dropping a weight into the interior 6 of the testing string, or may be of the annulus pressure operated type disclosed in U.S. Pat. No. 3,850,250 to Holden et al.

An upper pressure recorder 23, and a lower pressure recorder may be provided to record the closed in pressure and pressure build up curves used to evaluate the productivity of the formation being tested. Between the recorders 23 and 26 are weight and pressure responsive valve 24 disclosed herein, and weight operated valve 25. Weight operated valve 25 is preferably of the delayed opening, weight operated valve mechanism disclosed in U.S. Pat. No. 3,814,182 to Giroux, the full disclosure of which is herein incorporated by reference.

Valve 25, however, could be annulus pressure responsive valving mechanism such as that disclosed in U.S. Pat. 3,856,085 to Holden et al. which is arranged to open at a lower annulus pressure than valve 24.

Packer mechanism 27 is provided to isolate the formation 5, and to support the weight of the testing string 10 to operate valves 24 and 25. Such as packer is shown in U.S. Pat. No. 3,584,684 to Anderson et al. Perforated "tail pipe" 28 provides fluid communication between the interior 6 of the testing string 10 and formation 5.

The testing string 10 may additionally include other tools such as a hydraulic jarring mechanism of the type disclosed in U.S. Pat. Nos. 3,429,389 to Barrington or 3,399,740 to Barrington located between the lower pressure recorder 26 and packer 27, and safety joints of the type disclosed in U.S. Pat. No. 3,368,829 to Barrington located below the hydraulic jarring mechanism.

DESCRIPTION OF THE PREFERRED EMBODIMENT

Figure 2:
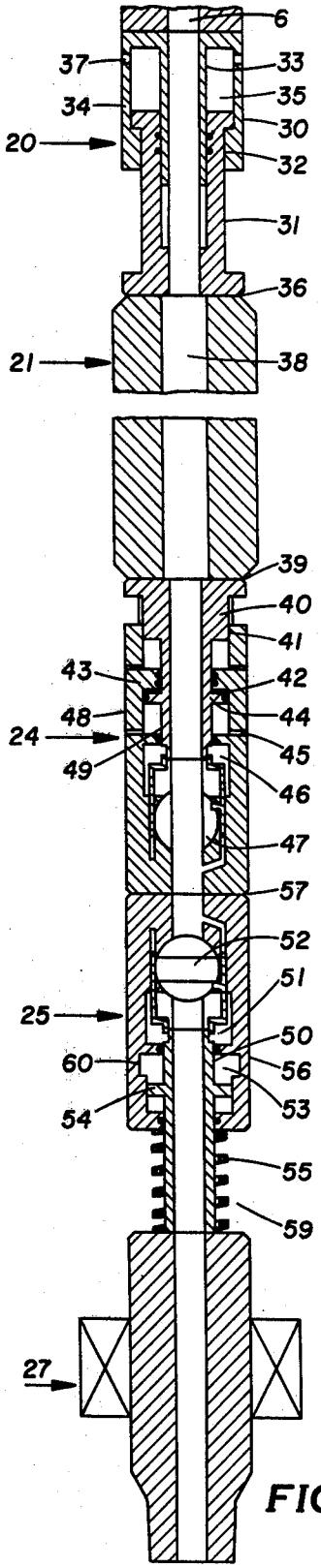

FIGS. 2–5 show the relationship of the slip joint 20; the intermediate weight imparting conduit string, referred to hereafter as "drill collars" 21; the weight and pressure responsive valve 24; the delayed opening, weight operated valve 25; and the packer 27, as they appear at selected times during the testing program. FIG. 2 is a representation of above listed tools during the running in process as the testing string 10 is being lowered into the well bore 3.

Slip joint 20 is shown in the fully extended position; weight and pressure responsive valve 24 is shown in the open position; weight operated valve 25 is shown in the closed position; and packer 27 is shown in the unextended or open position. Thus it can be seen that as the testing string 10 is lowered into the well bore, the testing string is closed at the bottom by valve 25. The interior bore 3 of the testing string 10 will then be at a different pressure than the fluid pressure in the well annulus 16 surrounding the testing string. This interior pressure might be atmospheric, or the interior bore 6 might at least partially filled with a liquid cushion of water, salt water, or diesel fuel oil.

Slip joint 20 has a tubular housing 30 with an outer housing wall 34 and an housing wall 33 forming an annular chamber 35 therebetween. The chamber 35 is in fluid communication with the well annulus through a plurality of ports 37. A tubular mandrel assembly 31 is located in chamber 35 and is splined with the outer housing at 32 to provide for the transmission of torque such that the rotation of the testing string above the slip joint will be transmitted to the testing string below the slip joint 20. It can be seen that when the slip joint is fully extended as shown in FIG. 2, the slip joint will support the weight of the testing string hanging below the slip joint.

Slip joint is connected to a length of drill collars 21 by a suitable threadable connection 36. Drill collars 21 are likewise shown connected to weight and pressure responsive valve 24 by connection 39.

Weight and pressure responsive valve 24 has a tubular operating mandrel 40 located in tubular housing 48. Mandrel 40 is splined to housing 48 at 41 to provide for the transmission of torque such that the rotation of the testing string above the valve 24 will be trasmitted to the testing string below the valve 24.

An annular sealed chamber 42 is formed between a thickened portion 43 of the housing 48 and an annular piston 44 formed on operating mandrel 40. Annular piston 44 is exposed on one side to fluid pressure in the annulus through a plurality of ports 45 in housing 48, and to the other side to the pressure in sealed chamber 42. The lower portion 49 of operating mandrel 40 co-acts with a lost motion bypass mechanism indicated generally as 46. Mechanism 46 controls the opening and closing of full opening ball valve 47. During the free travel of mechanism 46, a bypass around ball valve 47 is opened to reduce the pressure differential across the ball valve 47 before it is opened. In this case ball valve 47 is already in the open position as the testing tool is lowered into the well bore.

Weight and pressure responsive valve 24 is connected to weight operated valve 25 by a suitable threadable connection 57. However, an intermediate section of conduit may be similarly threadably connected between valves 24 and 25 if desired.

Weight operated valve 25 has a tubular housing 56 and an operating mandrel 50. Operating mandrel 50 co-acts with a lost motion bypass mechanism 51 similar to mechanism 46 in valve 24. Mechanism 51 opens and closes full opening ball valve 52, shown in FIG. 2 in the closed position.

Valve 25 includes a delay mechanism schematically represented by a fluid filled, hydraulic chamber 53 in housing 56, and a metering sleeve 54 formed on operating mandrel 50. Metering sleeve 54 restricts the movement of hydraulic fluid from the upper portion of chamber 53 to the lower portion of the chamber at a given rate, thus controlling the time it takes for metering sleeve 54 to move from one end of chamber 53 to the other.

A spring 55 in collapsing joint 59 of valve 25 holds the ball valve 52 in the closed position. When sufficient weight is set on the weight operated valve 25 to overcome spring 55, operating mandrel 50 begins to move up at a rate controlled by the passage of metering sleeve 54 through hydraulic chamber 53. When operating mandrel 50 moves up sufficiently to operate mechanism 51, ball valve 52 will be opened.

Weight operated valve 25 also provides for the transmission of torque by splining a section of operating mandrel 50 with housing 56 (not shown). More complete details and other factors of the delayed opening, weight operated valve 25 may be acquired by referring to Giroux U.S. Pat. No. 3,814,182 mentioned above and incorporated by reference herein.

Packer mechanism 27 is shown in the unextended position to allow for the passage of the testing string 10 into the well bore. Packer 27 is extended to engage the walls of the casing, and to isolate the formation to be tested by rotation of the testing string from the surface. This rotation is transmitted to the packer by the splined connections in the slip joint 20, the weight and pressure responsive valve 24, and the weight operated valve 25.

Figure 3:
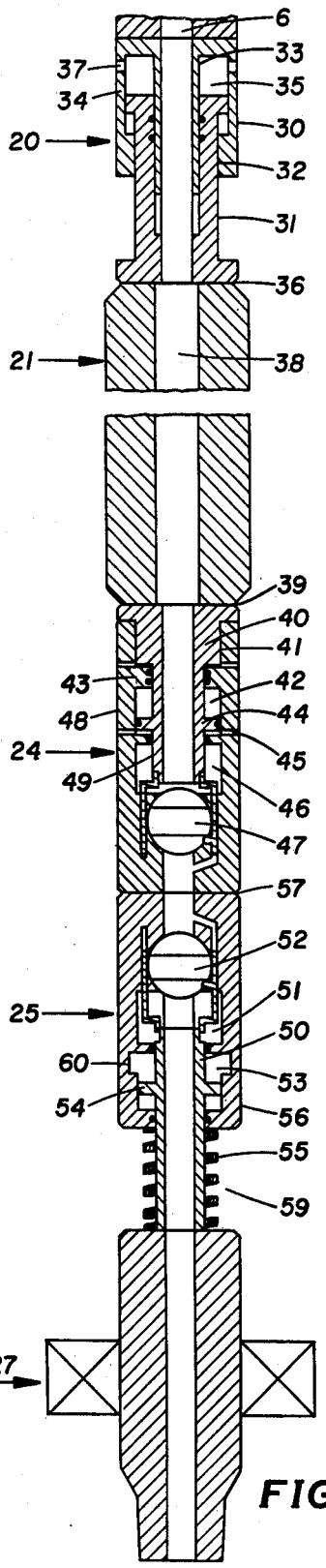

FIG. 3 illustrates the testing string of FIG. 2 after the packer 27 has been set, but before the delay provided for in valve 25 has elapsed. After the packer 27 is set, the testing string 10 is lowered hoisting means 11 until the slip joint 20 is partially collapsed. At this point it can be seen that the weight of drill collars 21 is supported by packer 27, and the remainder of the testing string is supported from above and hangs in the well. In the case of a floating work station as shown in FIG. 1, the slip joint must also absorb the wave action of the sea until the testing string is supported by the well head 7. If the free travel of one slip joint is not sufficient to absorb this wave action, several slip joints can be placed in series until sufficient free travel is provided. After the testing string 10 is supported by the wall head 7 and the preventer rams are closed to engage the subsea test tree 18, the work station 1 may move up and down with relation to the top of marine conductor 8 and upper conduit string 17 to isolate wave action from the supported testing string 10.

With slip joint 20 partially collapsed, the weight of drill collars 21 act on operating mandrel 40 to move mandrel 40 downward. As mandrel 40 moves downward, sealed chamber 42 expands, reducing the pressure therein. The lower portion 49 of mandrel 40 engages and operates lost motion and bypass mechanism 46, thereby closing ball valve 47. At this point both ball valve 47 and ball valve 52 are closed as shown.

It can be seen that a pressure differential exists across piston 44 because of the low pressure in the sealed chamber. An increase in annulus pressure will increase the pressure differential across piston 44. If other hydraulic forces acting on the testing string are balanced, annulus pressure may be increased until this pressure differential is sufficient to lift drill collars 21, thereby moving operating mandrel 40 up and reopening ball valve 47.

Figure 4:
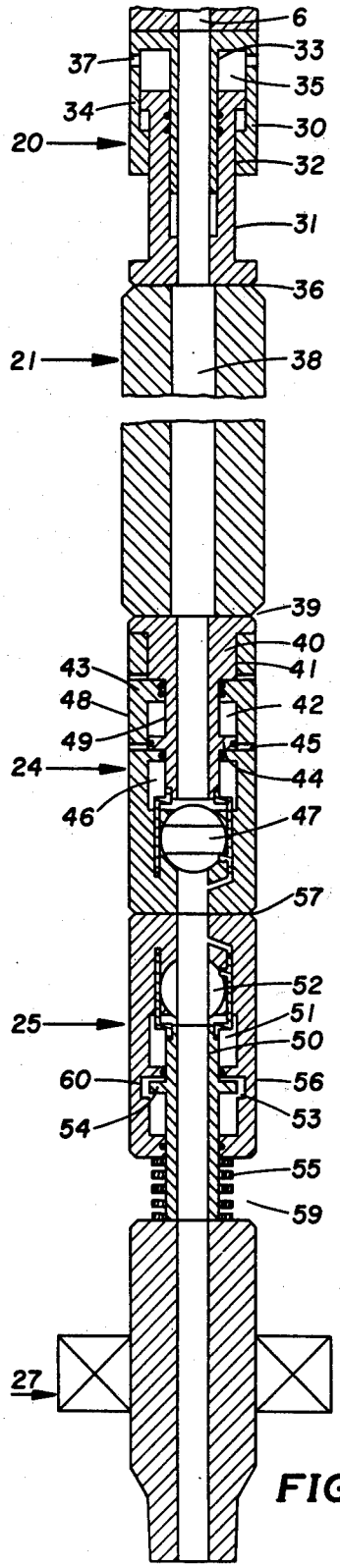

FIG. 4 illustrates the testing string of FIG. 3 after the delay of weight operated valve 25 has elapsed, and weight operated valve 25 has moved to the open position. The position of slip joint 20 and weight pressure operated valve 24 are the same as those shown in FIG. 3.

The weight of drill collars 21 acting on housing 56 acts to compress spring 55 and collapse joint 59. As joint 59 collapses, housing 56 moves downward causing a relative upward movement of mandrel 50 and associated metering sleeve 54 through fluid filled chamber 53. After sufficient time has elapsed, controlled by the rate at which metering sleeve 54 passes hydraulic fluid, mandrel 50 will engage lost motion and bypass mechanism 51. At this point it is desirable to unload metering sleeve 54 such that mandrel 50 can quickly complete the rest of its travel to open the ball valve 52. This is represented by an enlarged portion 60 of chamber 53.

During its free travel, lost motion and bypass mechanism 51 opens a bypass to reduce the pressure differential across ball valve 52, allowing the ball 52 to rotate more freely. With ball valve 52 open, fluid communication between the formation to be tested and the interior bore 6 of the testing string is controlled by ball valve 47 of weight and pressure responsive valve 24.

Figure 5:
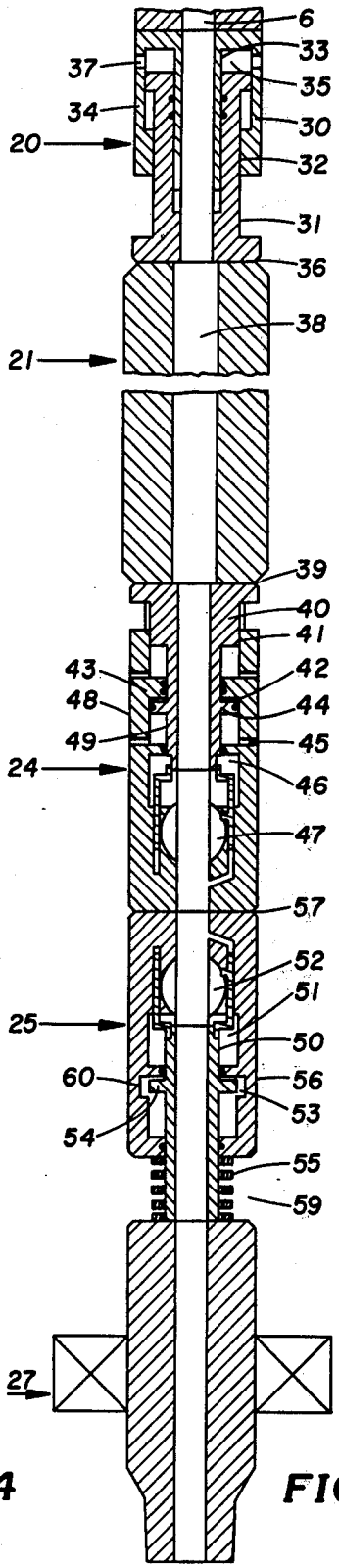
Figure 6A:
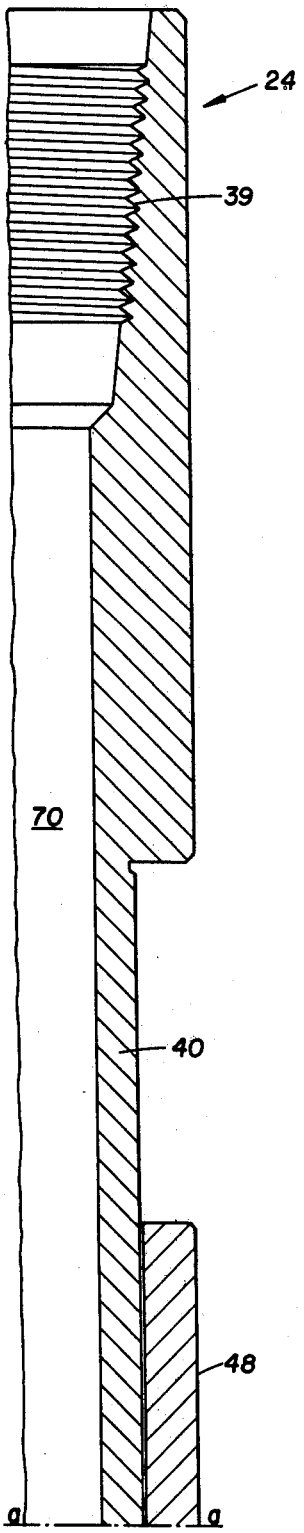
Figure 6B:
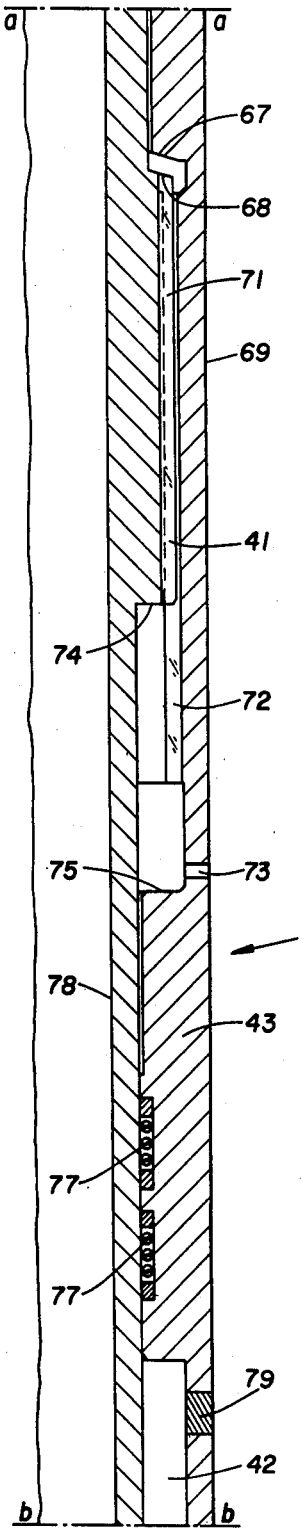
Figure 6C:
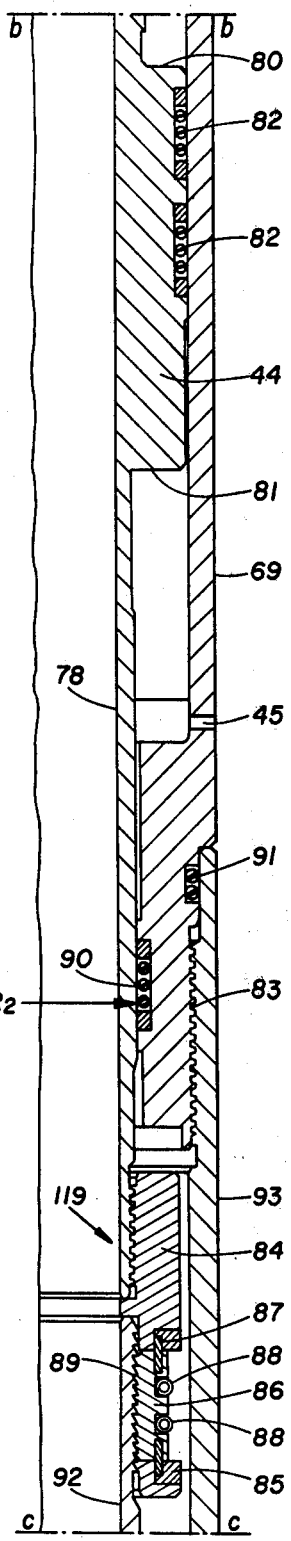
Figure 6D:
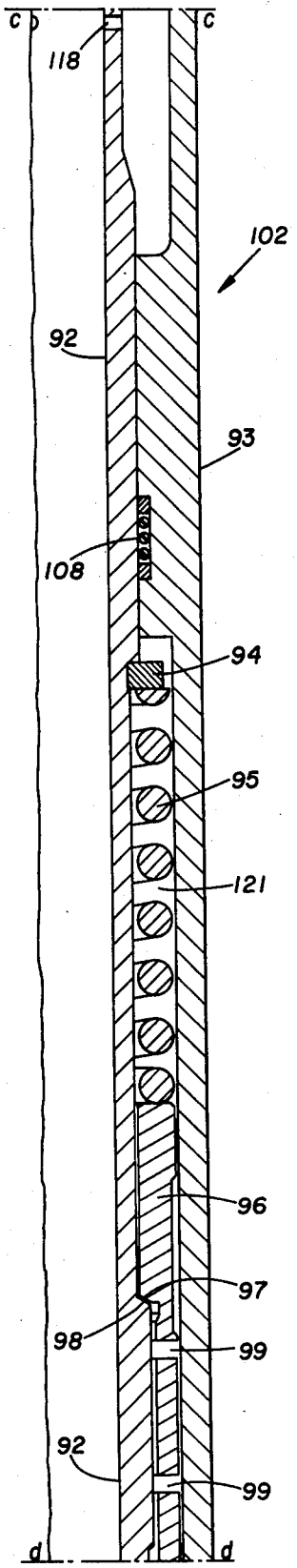
Figure 6E:
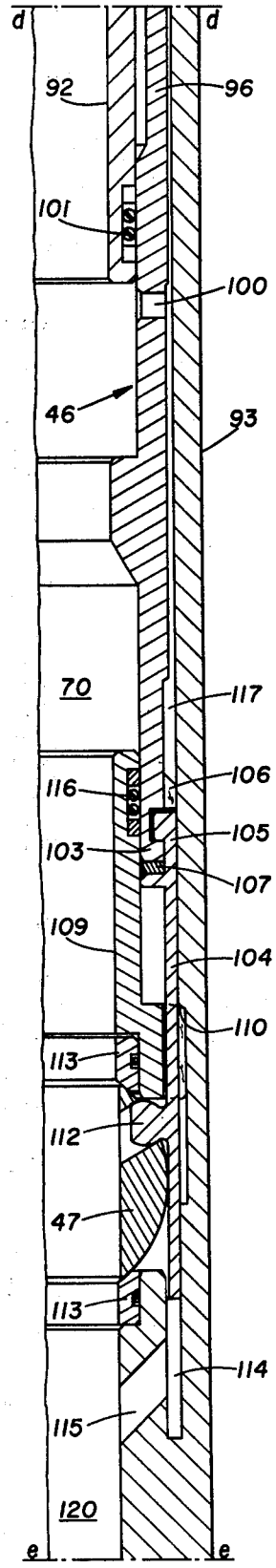
Figure 6F:
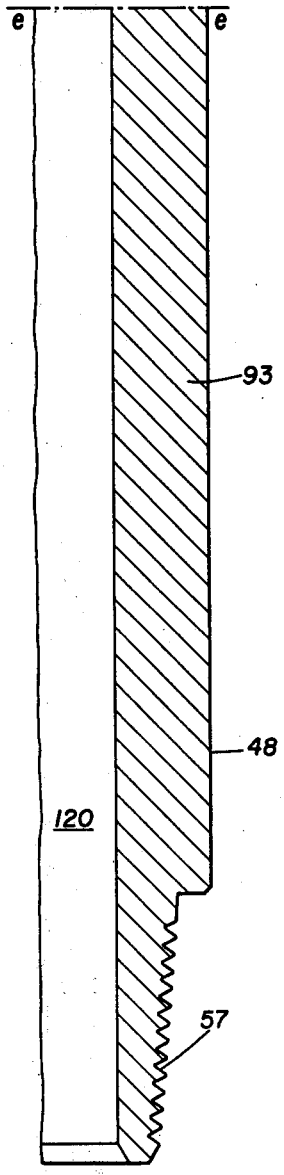

FIG. 5 illustrates the testing string of FIG. 4 after the annulus pressure has been increased sufficiently to overcome the weight of drill collars 21. When the weight of the drill collars 21 is overcome, operating mandrel 40 moves upward, operating lost motion and bypass mechanism 46 thereby rotating ball valve 47 to the open position. When the annulus pressure increases are removed, the weight of drill collars 21 will move operating mandrel 40 downward to rotate ball valve 47 to the closed position of FIG. 4. Thus, the opening and closing of ball valve 47 is positively operated responsive to the pressure in the wall annulus.

Slip joint 20 operates to absorb the movement of the operating mandrel 40 by moving tubular mandrel assembly 31 in chamber 35 as operating mandrel 40 moves up and down.

The ball valve 47 is supported by the housing 48 which is in turn supported by the extended packer 27 when weight operated valve 25 has opened, as shown in FIGS. 4 and 5. It can thus be seen that the cushion fluid above the closed ball valve 47 acting on the ball valve 47 is supported by the housing 48 and does not add to the apparent weight acting on operating mandrel 40. However, if the flow passage 38 in drill collars 21 is larger than the flow passage in weight and pressure responsive valve 24 above the ball valve 47 as shown in FIGS. 2–5, then the weight of the cushion fluid in the enlarged annular portion of flow passage 38 will add to the apparent weight acting on operating mandrel 40. If the cushion fluid in flow passage 38 is replaced by less dense formation fluid, then the apparent weight acting on operating mandrel 40 will be lightened by the difference in the weight of the volume of fluid occupying the enlarged annular portion of flow channel 38.

Therefore, the lifting force generated by well annulus pressure acting on piston 44 must be great enough to initially lift the heavier drill collars 21 filled with cushion fluid, and the weight of the drill collars filled with formation fluid must be heavy enough to reclose ball valve 47 after the cushion fluid has been displaced from the flow channel 38 of drill collars 21.

It can be seen that the disclosed testing string will result in a testing string which will immediately close the interior bore 6 if some component should fail. If annulus pressure is lost during the testing program while ball valve 47 is open, the weight of drill collars 21 will immediately close ball valve 47. A rupturable port means which will open if there is an overpressure in the annulus may be provided in that portion of the wall of housing 48 separating the sealed chamber 42 from the annulus. Thus, an overpressure in the annulus would open the rupturable port means to communicate the annulus pressure to both sides of annulus piston 44. In this case, the pressure differential holding up the weight of drill collars 21 would be lost, and drill collars 21 would again close ball valve 47.

If the testing string 10 should part, the additional weight of the string as it fell into the well bore would also close ball valve 47 of weight and pressure responsive valve 24.

FIGS. 6a–6f, joined along section line a—a through e—e, provide a view of the preferred weight and pressure responsive valve 24. Weight and pressure responsive valve 24 includes threadable connection 39 for joining valve 24 with the testing string above valve 24. Valve 24 is made up of two separable portions; an operating section, shown generally in FIGS. 6a–6c as 76, and a valve section, shown generally in FIGS. 6d–6f as 102. Running throughout the major portion of the tool is the operating mandrel 40, referred to in connection with FIGS. 2–5, which is made up of an upper operating mandrel 78 located in operating section 76, and a lower operating mandrel 92 located in valve section 102. The operating mandrel components 78 and 92 have an open interior bore 70 communicating with the interior bore 6 of the testing string.

The housing 48, referred to in connection with FIGS. 2–5, is made up of an operating section housing 69 and a valve section housing 93. Thus, thickened portion 43 is a portion of the operating section housing 69. The splined area 41 mentioned earlier is made up of splines 72 on the operating section housing 69, and splines 71 on the upper operating mandrel 78. Downward facing face 74 of the mandrel splines 71, and upward facing face 75 of thickened portion 43 limit the amount of telescopic travel made by the operating mandrel 40 in the relative downward direction into housing 48. Upward facing face 68 of mandrel splines 71, and downward facing face 67 of the upper portion of operating section housing 69 limit the amount of telescopic travel made by the operating mandrel 40 in the relative upward direction out of housing 48.

Port 73 provided in the wall of operating section housing 69 prevents hydraulic lock up during the telescopic movement. A sealed chamber 42 is formed between the thickened portion 43 and an annular piston 44 formed on the upper operating madrel 78. Seals 77 and 82 are provided to seal the sealed chamber 42 from fluid pressure of the well annulus 16.

The annular piston 44 has a sealed chamber responsive face 80 exposed to the pressure in the sealed chamber 42, and an annulus pressure responsive face 81 exposed to the pressure in the well annulus 16 and communicated to face 81 by a plurality of ports 45 in the wall of housing 69.

A self adjusting, separable connecting means, identified generally as 119, is provided to join operating section 76 to valve section 102. The connecting means includes a threadable connection 83, which joins operating section housing 69 to valve section housing 93, and a ratchet mechanism for joining upper operating mandrel 78 to lower operating mandrel 92.

A ratchet block retainer 84 is connected to the lower portion of upper operating mandrel 78, and has a window 85 provided for receiving a ratchet block 86. Ratchet block 86 is held in place by keepers 87 which prevent the ratchet block 86 from passing through the window 85 in retainer 84. Coil springs 88 resiliently hold ratchet block 86 in place. Helical ratchet teeth 89 are provided on ratchet block 86 and the upper portion of lower operating mandrel 92, and coengage one another to allow lower operating mandrel 92 to ratchet upward in relation to ratchet block 86, but hold when ratchet block 86 is moving upward in relation to lower operating mandrel 92. Since ratchet teeth 89 are helical, they will unscrew when threadable connection 83 is unscrewed.

The connection may be made up by screwing connection 83 together. The stiffness of the mechanism below the connecting means 119 will ratchet the upper portion of lower mandrel 92 under ratchet block 86. If the lower operating mandrel 92 is not completely seated, the first operation of the upper operating mandrel 78 will completely ratchet lower operating mandrel 92 into place as shown.

To break the tool down, it is only necessary to unscrew connection 83. The rotation of the valve section 102 in relation to the operating section 76 will also unscrew the helical teeth 89.

Seals 90 and 91 are provided to seal the interior bore 70 from the well annulus 16. Ports 118 are provided in lower operating mechanism 92 to prevent hydraulic lock-up during the operating movement of the operating mandrels 78 and 92.

The movement of lower operating mandrel 92 in valve section 102 opens and closes ball valve 47, thus controlling fluid communication with the interior bore 120 below the ball 47 with the interior bore 70 above the ball 47. Actual operation of the ball valve 47 is controlled by the lost motion and bypass mechanism shown generally as 46.

Mechanism 46 includes a coil spring 95 located in a spring chamber 121 between the valve section housing 93 and the lower operating mandrel 92, and arranged as shown to compress upon relative movement between the lower operating mandrel 92 and a ball operating mandrel 96. A metal keeper 94 is provided in spring chamber 121 and is attached to lower operating mandrel 92 for applying force to spring 95 upon movement of lower operating mandrel 92.

A raised shoulder 97 of ball operating mandrel 96 coacts with a raised shoulder 98 of lower operating mandrel 92, as shown, such that when lower operating mandrel 92 moves up, ball operating mandrel 96 is pulled with it. However, when lower operating mandrel 92 moves downward, shoulders 96 and 97 are disengaged, and ball operating mandrel 96 is pushed downward by the action of spring 95 being pushed by keeper 94 which is attached to lower operating mandrel 92.

A plurality of bypass ports 100 are provided in ball operating mandrel 96 which are opened and closed by seals 101 on the lower portion of lower operating mandrel 92.

The lower portion of ball operating mandrel 96 is provided with interlocking fingers 103 which interlock with interlocking finger portions 105 of arms 104 as shown. Arms 104 extend on either side of the ball valve 47, and are provided with camming pins 112 which rotate ball valve 47 between the opened to the closed position. A cushion means 107 is provided between ball operating mandrel 96 and arms 104.

A ball valve seat keeper 109 is engaged with the valve section housing 93 in recess 110 to hold the ball valve seats 113 in position.

A bypass flow passageway is provided from the interior bore 120 below the ball 42 to the interior bore above the ball 47 by way of bypass port 115 in the lower portion of housing 93, bypass channel 114, slots 106 in the lower portion of ball operating mandrel 96, bypass channel 117, and bypass ports 100. Bypass channel 114 also accommodates the sliding movement of arms 104. Seals 108 and 116 provide a fluid tight seal between the bypass flow passageway and the interior bore 70 of the tool above the ball 47.

The upper portion of ball operating mandrel 96 has a plurality of offset slots around its periphery to allow the mandrel to deform slightly. Thus, if the tolerances of the mechanism are such that the lower operating mandrel 92 is still acting on the ball operating mandrel 96 after the ball has been rotated, the ball operating mandrel 96 will deform sufficiently until faces 67 and 68, or faces 74 and 75 stop further movement, thus relieving the stress in pins 112 to prevent them from being separated from arms 104.

An annulus overpressure protection device is schematically depicted as 79 in the wall of the operating section housing 69 which separates the sealed chamber 42 and the well annulus 16. This overpressure protection device may be a selectively operating device such as a rupturable port means or a valve which opens when sufficient excess pressure is added to the well annulus fluid. It can be seen that if ball valve 47 is being held open due to a pressure differential across piston 44, the opening of device 79 in response to an overpressure in the annulus will remove the pressure differential across piston 44 and thereby cause ball valve 47 to close.

Threadable connection 57 is provided at the lower end of the valve section housing 93 to allow the weight and pressure responsive valve 24 to be connected to the testing string below the valve.

FIGS. 7*a* and 7*b*, joined along section line *x—x*, present a view of the preferred slip joint 20. Slip joint 20 includes a tubular housing 30 and an inner tubular mandrel assembly 31 which co-act to give an interior bore 140 which communicates with the interior bore 6 of the testing string above and below the slip joint. Housing 30 has an outer housing wall 34 and an inner housing wall 33 which form the boundaries of chamber 35 therebetween. The inner mandrel 31 is arranged for telescopic movement within the chamber 35.

The splined area 32, referred to in connection with FIGS. 2–5, includes splines 133 on mandrel 31 and coacting splines 132 on outer housing wall 34. Upward facing faces 135 on splines 132 and downward facing face 134 of the upper portion of mandrel 31 limit the telescopic movement of the mandrel 31 in the relative downward direction out of housing 30.

A plurality of ports 37 through the upper portion of housing wall 34 prevents hydraulic lock-up during the telescopic movement of mandrel 31 within chamber 35. Threaded connections 130 and 36, at the upper end of housing 30 and the lower end of mandrel assembly 31 respectively, allow the slip joint to be connected to the testing string 10 above and below the slip joint.

Seals 131 are provided to give a fluid tight seal between the interior bore 140 of the slip joint and the annulus 16 of the well. Seals 131 are spaced a specified distance, represented by radius R1, from the center axis of the slip joint 20. This distance is equal to the distance, represented by radius R2, by which seals 90 are spaced from the center axis of the weight and pressure responsive valve 24. It can thus be seen that while slip joint 20 and valve 24 are not individually pressure balanced, when they are placed in the same conduit string they will act to pressure balance each other. Thus forces will not be created in the testing string between the slip joint 20 and the valve 24, other than the up force acting on piston 44, due to hydraulic forces in either the interior bore of the testing string components or the well annulus 16.

OPERATION OF THE PREFERRED EMBODIMENT

The testing string 10 is lowered into the well bore 3, the packer 27 is set, and the slip joint 20 is partially collapsed as previously described. The weight of the drill collars 21 will be acting on operating mandrel 40, causing it to move downwardly within housing 48. With this downward movement, piston 44 on upper operating mandrel 78 will also move down, expanding the volume of sealed chamber 42. Chamber 42 originally contains air at atmospheric pressure trapped when the tool is assembled. The pressure in chamber 42, after movement of piston 44 ceases, will depend on the final volume and temperature of the chamber 42; but will be much less than the hydrostatic pressure of the drilling fluid in the annulus.

As the upper operating mandrel 78 is moved down, connecting means 119 and lower mandrel 92 will also be moved downward. Shoulders 97 and 98 will disengage; however, ball operating mandrel 96 will also be pushed down by partially compressed spring 95 in spring chamber 121. Ball operating mandrel 96 will also push arms 104 engaged by interlocking fingers 103 and 105, thereby rotating ball valve 47 to the closed position by the action of pins 112.

At this point arms 104 and ball operating mandrel 96 will stop their downward movement. Operating mandrels 78 and 92 will continue moving downward, further compressing spring 95. During this free travel, bypass port 100 will be closed off by seals 101, thus closing the bypass flow passage around the ball valve 47. Downward movement of operating mandrels 78 and 92 will cease when faces 74 and 75 come together. The weight and pressure responsive valve 24 is now in the closed position.

The operation of weight responsive valve 25 is set out in columns 7–10 of U.S. Pat. No. 3,814,182 mentioned above.

When it is desired to reopen weight and pressure responsive valve 24, the pressure in the well annulus is increased until the up force generated by the pressure differential across piston 44 is sufficient to lift drill collars 21. When the weight of drill collars 21 is overcome, operating mandrels 78 and 92 begin to move upward. Compressed spring 95 will hold ball operating mandrel and arms 104 down, thus holding ball valve 47 closed, until shoulders 97 and 98 are engaged.

During the initial free travel of lower operating mandrel 92, bypass port 100 is uncovered thereby opening the bypass flow channel around the closed ball valve 47. Fluid flow in the bypass channel will reduce the pressure differential across the ball valve 47, thereby making the rotation of the ball easier. Thus, the bypass is closed at the end of the operating stroke when the ball is being closed, and is opened at the beginning of the operating stroke when the ball is being opened.

After shoulders 97 and 98 are engaged, lower operating mandrel 92 will pull ball operating mandrel 96 upward, thereby opening ball valve 47. The mandrels 78 and 92 will continue to move upward until faces 67 and 68 are engaged. If the ball valve is fully opened before faces 67 and 68 are engaged, or is fully closed before faces 74 and 75 are engaged, slots 99 will allow ball operating mandrel 96 to deform sufficiently to prevent pins 112 from being pulled off of arms 104. Weight and pressure responsive valve 24 is now in the open position allowing communication between the formation and the interior 6 of the testing string 10.

Tubular mandrel 31 moves in chamber 35 during a corresponding movement of operating mandrels 78 and 92, thereby absorbing these movements without affecting the testing string 10 above the slip joint 20.

The weight and pressure responsive valve 24 operates responsive to a weight for the drill collars which has preferably been determined from the depth of the testing string, the drilling fluid used, the cushion fluid used, and the dimensions of the drill collars. It can be seen that the lifting force acting on the differential area of piston 44 responsive to the well annulus pressure may be divided into two parts; the force generated in response to the hydrostatic pressure of the drilling mud, and the force generated in response to the pump pressure added to the fluid pressure in the well annulus.

It can be seen that when a weight equal to the force created by the hydrostatic pressure of the mud acts on operating mandrel 40, the hydrostatic force generated by the drilling fluid will be balanced, and any additional weight will tend to move operating mandrel 40 downward to operate the valve 24 as set out above. The preferred amount of weight to add to the drill collars over what is required to balance drilling mud hydrostatic pressure is an amount equal to half the force generated by the maximum allowable pump pressure which may be added to the well annulus. The maximum pump pressure is determined by determining the maximum amount of pressure which may be added to the well before a failure will occur, and then subtracting a safety margin.

Sufficient weight is added to the drill collars to balance the force of the hydrostatic pressure of the drilling mud. Additional weight, preferably equal to one half the force generated by the maximum allowable pump pressure, is then added to the drill collars to expand sealed chamber 42 and overcome seal friction, thereby moving operating mandrel 40 downward. This leaves the remaining half of the pump pressure to generate a force to overcome seal friction and move the operating mandrel upward without exceeding the maximum allowable pressure of the well.

The length (L) of the drill collars or pipe 21 to be used may be calculated in accordance with the equation:

$$L = \frac{.052\, AM_W \text{Depth} + A\,(P_p/2)}{DC_{Air} + .0408\, C_w d^2 + .1632\, R^2 M_w - .0408\, M_w D^2 - .1632\, R^2 C_w}$$

where: $A$ = the differential area responsive to annulus pressure in square inches of piston 44;

$M_w$ = Mud weight per gallon in lbs/gal;

Depth = Depth of weight and pressure responsive valve 24 in feet;

$P_p$ = Annulus pump pressure in psi where the maximum is a maximum allowable pressure limit less a safety margin;

$DC_{Air}$ = The drill collar weight per foot is air in lbs/ft;

$C_w$ = The cushion fluid weight per gallon in lbs/gal;

$d$ = The inside diameter of the drill collars in inches;

$D$ = The outside diameter of the drill collars in inches; and $R$ = The radius that seals 90 and 131 are spaced from the center axis of the interior bore.

The use of this equation will give sufficient drill collar weight to close the weight and pressure responsive valve 24 after all the cushion fluid has been displaced by gas, and will be light enough to be lifted along with the cushion fluid in the annular enlarged portion of the flow passage 38 before the pump pressure exceeds a maximum pressure limit of the well.

A circulation valve 22 shown in FIG. 1 is normally placed between drill collars 21 and weight and pressure responsive valve 24 of FIGS. 2–5, and has been deleted to make those figures simpler. The circulation valve may be opened in a variety of ways such as by increased pressure in the testing string interior 6, rotation of the testing string, dropping of a weight, or may be operated by annulus pressure as in the Holden et al. U.S. Pat. No. 3,850,250 mentioned earlier, and incorporated by reference herein. The circulation valve disclosed in Holden may be used with the operating mechanism disclosed herein by separating the power section 11 shown in FIGS. **1*d*–1*f* of the Holden Patent from the circulation valve 1, adapting intermediate housing 14 shown in FIG. 1*d* of Holden to join with the operating section housing 69 at 83 with a suitable threaded connecting adapter, and adapting lower mandrel section 14 shown in FIG. 1*d* of Holden to ratchet into connecting means 119**.

A circulation valve of this configuration would ratchet the pull mandrel 5 of Holden downward into latch mandrel 2 of Holden with each downward movement of upper operating mandrel 78 of the present disclosure. With each upward movement of the upper operating mandrel 78 of the present disclosure, the pull mandrel 5 of Holden will lift mandrel skirt 21 of Holden until ports 31 of Holden are uncovered, thereby opening the circulation valve. The hydraulic delay shown in FIG. **1*d*** of Holden would prevent the circulation valve described from ratcheting prematurely during pressure surges while being lowered into the well bore.

The number of pressure applications necessary to control the opening of such a circulation valve could be controlled by placing an appropriate spacer between faces 67 and 68 of an operating section of the present application joined with a Holden circulation valve in the manner described.

The annulus pressure responsive testing apparatus herein disclosed is a much improved, simplified testing apparatus over those heretofore known. Those skilled in the well testing art and the operating environment of well testing tools, and familiar with the present disclosure may envision additions, deletions, substitutions, or other modifications or alterations which would fall within the scope of the invention as set forth in the appended claims.

What is claimed is:

1. In the testing of an underground formation intersected by a fluid filled well bore extending from the earth's surface to the formation, wherein the formulation is tested with a testing string having a flow passage therethrough, a normally closed valve in the lower portion of the testing string for opening and closing the flow passage, and a weight and pressure responsive valve located in the testing string adjacent said normally closed valve for closing the flow passage responsive to weight and opening the flow passage responsive to pressure, a method comprising the steps of:

lowering the testing string into the well bore to the formation depth;

isolating the formation from the fluid pressure in the well bore above the formation;

applying weight to the weight and pressure responsive valve, thereby closing the flow passage adjacent said normally closed valve;

opening the normally closed valve subsequent to the closing of said weight and pressure responsive valve; and, increasing the fluid pressure in the well bore above the formation, thereby opening said weight and pressure responsive valve to provide fluid communication between the surface and the formation.

2. The method of claim 1 wherein the normally closed valve opens in response to weight, the applying weight step additionally applies weight to said weight responsive normally closed valve, and the method additionally comprises the step of delaying the opening of said weight responsive valve until after said weight and pressure responsive valve closes responsive to said applied weight.

3. The method of claim 2 further comprising the steps of:

providing for motion in said weight and pressure responsive valve in a first direction responsive to said applied weight, and in a second opposite direction responsive to said fluid pressure increase;

providing a slip joint means in said testing string above a weight applying portion of the testing string for isolating movement in the testing string below said slip joint means from the testing string above said slip joint means; and, absorbing motion, within said slip joint means, of the testing string below said slip joint means caused by the opening and closing of said weight and pressure responsive valve.

4. The method of claim 3 further comprising the steps of:

providing in the testing string adjacent said weight and pressure responsive valve, a normally closed weight and pressure responsive circulation valve for controlling fluid communication between the well bore above the formation and said flow passage in the testing string;

providing for motion in said weight and pressure responsive circulation valve in a first direction responsive to said applied weight, and in a second opposite direction responsive to said fluid pressure increase;

restricting said motion in said weight and pressure responsive circulation valve for delaying the completion of said motion in said first and second directions; and, maintaining said weight and pressure responsive circulation valve in the closed position, whereby fluid communication is blocked between the well bore and the flow passage, for a predetermined number of motions in said first and second directions; and, subsequent to said predetermined number of motions, opening said weight and pressure responsive circulation valve, thereby providing communication between the well bore and said flow passage.

* * * * *

UNITED STATES PATENT AND TRADEMARK OFFICE

CERTIFICATE OF CORRECTION

PATENT NO. : 4,059,153

DATED : November 22, 1977

INVENTOR(S) : George J. Nix, Burchus Q. Barrington, David L. Farley, and Norman G. Hortman It is certified that error appears in the above-identified patent and that said Letters Patent are hereby corrected as shown below:

Column 2, line 40, "backers" should read --packers--

Column 2, line 65, "pullify" should read --nullify--

Column 3, line 18, "spring" should read --string--

Column 5, line 15, "safety" should read --safely--

Column 5, line 25, after "recorder" insert the number --26--

Column 5, line 40, "as" should be --a--

Column 6, line 2, the number "3" should be --6--

Column 6, line 9, before "housing", second occurrence, insert --inner--

Column 6, line 21, after "joint" insert the number --20--

Column 7, line 35, "wall" should read --well--

Column 8, line 10, before "allowing" insert --thereby--

UNITED STATES PATENT AND TRADEMARK OFFICE

CERTIFICATE OF CORRECTION

PATENT NO. : 4,059,153

DATED : November 22, 1977

INVENTOR(S) : George J. Nix, Burchus Q. Barrington, David L. Farley, and Norman G. Hortman It is certified that error appears in the above-identified patent and that said Letters Patent are hereby corrected as shown below:

Column 8, line 67, "annulus" (second occurrence) should read -- annular --.

Column 9, line 43, "madrel" should read --mandrel--

In claim 1 at column 14, lines 60 and 61, "formulation" should read --formation--

In claim 4 at column 16, line 31, before "communication" insert --fluid--.

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*